US009931866B2

(12) United States Patent
Olsen et al.

(10) Patent No.: US 9,931,866 B2
(45) Date of Patent: Apr. 3, 2018

(54) MEDIA CRASH PREVENTION SURFACE TO CONTACT AND GUIDE MEDIA

(71) Applicant: HEWLETT-PACKARD DEVELOPMENT COMPANY, L.P., Houston, TX (US)

(72) Inventors: David Olsen, Corvallis, CA (US); Thomas W Ruhe, Vancouver, WA (US); Robert Reiss, Vancouver, WA (US); Alan Shibata, Vancouver, WA (US); Todd M Gaasch, Vancouver, WA (US); Raymond C Sherman, Vancouver, WA (US); Robert Yraceburu, Vancouver, WA (US); Hunter Cantrell, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/505,579

(22) PCT Filed: Aug. 19, 2014

(86) PCT No.: PCT/US2014/051710
§ 371 (c)(1),
(2) Date: Feb. 21, 2017

(87) PCT Pub. No.: WO2016/028281
PCT Pub. Date: Feb. 25, 2016

(65) Prior Publication Data

US 2017/0266994 A1 Sep. 21, 2017

(51) Int. Cl.
*B41J 11/00* (2006.01)

(52) U.S. Cl.
CPC ..... *B41J 11/005* (2013.01)

(58) Field of Classification Search
CPC ..... B41J 11/006; B41J 11/0065; B41J 11/007; B41J 11/005; B41J 13/0054; B41J 13/103;
(Continued)

(56) References Cited

U.S. PATENT DOCUMENTS 5,222,820 A 6/1993 Kamei et al.
6,908,242 B2 6/2005 Oshima et al.
(Continued)

FOREIGN PATENT DOCUMENTS

JP 05-162397 6/1993
JP 09-255201 9/1997
(Continued)

OTHER PUBLICATIONS

Hewlett-Packard Development Company, L.P., HP DesignJet H35000 Printer Series, Sep. 2008, http://ccserver.copiercatalog.com/catalogfiles/H_35500_sales.pdf, 4 pgs.
International Searching Authority. ISA/KR. International Search Report, dated May 13, 2015. Application No. PCT/US2014/051710.

*Primary Examiner* — Kristal Feggins
(74) *Attorney, Agent, or Firm* — HP Inc. Patent Department

(57) ABSTRACT

An interleave member including a media control conforming surface and a media, crash prevention surface. The media crash prevention surface to periodically contact and guide the media to the media control conforming surface. The media control conforming surface conforming to a surface of the media control member.

15 Claims, 10 Drawing Sheets

(58) Field of Classification Search
CPC . B41J 13/106; B41J 13/12; B41J 13/18; B41J 13/223; B41J 13/226; B41J 13/24; B41J 13/32; B41J 15/044; B41J 15/048; B41J 15/18; B41J 17/02; B41J 17/18; B41J 17/20
See application file for complete search history.

(56) References Cited

U.S. PATENT DOCUMENTS

| | | | | |
|---|---|---|---|---|
| 7,237,888 | B2 * | 7/2007 | Silverbrook | B41J 11/001 347/102 |
| 8,376,498 | B1 | 2/2013 | Mandel et al. | |
| 8,746,694 | B2 | 6/2014 | Moore et al. | |
| 9,002,257 | B2 * | 4/2015 | Saiga | B41J 13/106 399/405 |
| 2001/0046405 | A1 * | 11/2001 | Miyazaki | B41J 11/00 400/605 |
| 2012/0133719 | A1 | 5/2012 | Toriihara et al. | |
| 2013/0195534 | A1 | 8/2013 | Oohara et al. | |

FOREIGN PATENT DOCUMENTS

| | | |
|---|---|---|
| JP | H09-254472 | 9/1997 |
| JP | 11-138923 | 5/1999 |
| JP | 2006-076144 | 3/2006 |
| JP | 2012166867 | 9/2012 |
| WO | WO-2014003719 | 1/2014 |

* cited by examiner

MEDIA CRASH PREVENTION SURFACE TO CONTACT AND GUIDE MEDIA

BACKGROUND

Printing systems include printheads and media control members. The printheads provide printing fluid on media placed along a media path in a print zone. The media control members guide the media along the media path.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Figure 1:
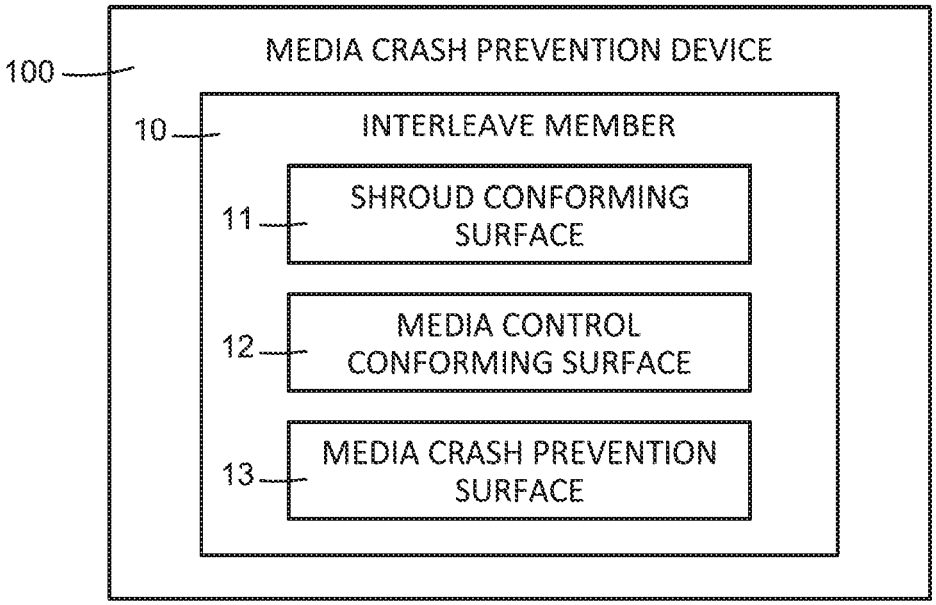
FIG. 1 is a block diagram illustrating a media crash prevention device according to an example.

Printing systems such as page-wide array printers include media control members and printheads. The printheads may be printbars, printhead assemblies, and inkjet printheads, and the like. The media control members guide media along a media path, for example, towards and away from a print zone. Media may include paper, cloth, and the like. Media control members may include cowcatchers, rollers, belts, and the like. Cowcatchers are media control members of printing systems that receive and guide media along a media path. Cowcatchers may include star wheels to transport media. The print zone may include an area between and adjacent to the printheads and the media path. The print zone is an area that receives the media for the printheads such as inkjet printheads to provide printing fluid onto the media therein.

The media control members such as cowcatchers guide the media along the media path. For example, the cowcatcher may receive the printed media from the print zone after the printhead provides printing fluid thereon and guide it to continue along the media path. At times, however, the printed media may form curls including cockles caused by freshly deposited printing fluid thereon. That is, the printing fluid such as water-based inks may cause media fibers on a wet side of the media to swell and other media fibers on the dry side of the media to remain unchanged causing uneven swelling of the media. Such uneven swelling may result in media curl. The media curl may straighten out over time as water of the printing fluid deposited on the media evaporates.

Media crashes may result from uncontrolled media curl within the media path, for example, in the print zone. That is, a leading edge of the curled media may undesirably catch on respective edges and/or transitions in the print zone downstream of the shroud. The shroud, for example, may include a raised portion of a printhead to protect a nozzle surface. In duplex printing, a media curl may be formed after a first side of the media is printed on. Subsequently, when the media is transported back into the print zone to be printed on by the printhead, the media curl may catch on transitions and/or edges downstream of the shroud causing a media crash. Thus, printing system components may be damaged, throughput may be reduced, and/or media may be wasted.

In examples, a media crash prevention device is usable with a printhead. The printhead is movable between a printing position and a maintenance position. The printhead includes a shroud. In the printing position, the printhead may move toward a media path. In the maintenance position, the printhead may move away from the media path for the printhead to be cleaned, serviced and/or capped. The media crash prevention device includes an interleave member. The interleave member includes a shroud conforming surface, a media control conforming surface, and a media crash prevention surface.

The shroud conforming surface is positioned proximate to and across from the shroud, for example, in response to the media crash prevention device being coupled to the printhead. The media control conforming surface is positioned proximate to and across from a media control member in the printing position and away from the media control member in the maintenance position. The media crash prevention surface periodically contacts and guides the media to the media control member in the printing position. The control media conforming surface and the media crash prevention surface are moved along with the printhead to the printing position and the maintenance position. Accordingly, the media crash prevention device coupled to the printhead provides an integrated function to guide the media in the print zone to the media control member downstream from the printhead in a media transport direction. Thus, media crashes are reduced. Consequently, damaged printing system components, decreased throughput, and wasted media may be reduced.

FIG. 1 is a block diagram illustrating a media crash prevention device according to an example. In some examples, a media crash prevention device 100 is usable with a printhead. The printhead may be in a form of a printbar, a printhead assembly, and/or an inkjet printhead, and the like. Referring to FIG. 1, in some examples, the media crash prevention device 100 includes an interleave member 10 to couple to the printhead. The printhead may include a shroud surrounding a nozzle surface thereof. For example, the shroud may include a raised portion of the printhead to protect the nozzle surface. In some examples, the shroud may surround a plurality of nozzle surfaces in the form of printhead dies. The printhead may be movable between a printing position and a maintenance position. In the printing position, for example, the printhead may move toward a media path to print on the media. In the maintenance position, for example, the printhead may move away from the media path to clean, service, and/or cap the printhead.

Referring to FIG. 1, in some examples, the interleave member 10 includes a shroud conforming surface 11, a media control conforming surface 12, and a media crash prevention surface 13. The shroud conforming surface 11 is to be positioned proximate to and across from the shroud. For example, the shroud conforming surface 11 may be maintained at a close and constant distance from the shroud when the interleave member 10 is coupled to the printhead. The media control conforming surface 12 is to be positioned proximate to and across from a media control member in the printing position. The media control conforming surface 12 is to be positioned away from the media control member in the maintenance position. For example, the media control conforming surface 12 may move along with the printhead between the printing position and the maintenance position when the interleave member 10 is coupled thereto.

Referring to FIG. 1, in some examples, the media crash prevention surface 13 periodically contacts and guides a media to the media control member, for example, in the printing position. That is, a leading edge of a curled media may hit the media crash prevention surface 13 in a non-binding manner and be directed downstream from the printhead in a media transport direction towards the media control member. For example, in duplex printing, a media curl may be formed after a first side of the media is printed on. Thus, when the printed media is transported back into the print zone for the second side thereof to be printed on by the printhead, the media curl may cause a leading edge of the media to contact and be guided by the media crash prevention surface 13. The media crash prevention surface 13 may move along with the printhead between the printing position and the maintenance position. Thus, media crashes due to media curl may be reduced. Additionally, in the maintenance position, the media and the media crash prevention surface 13 may be cleaned along with the printhead.

Figure 2:
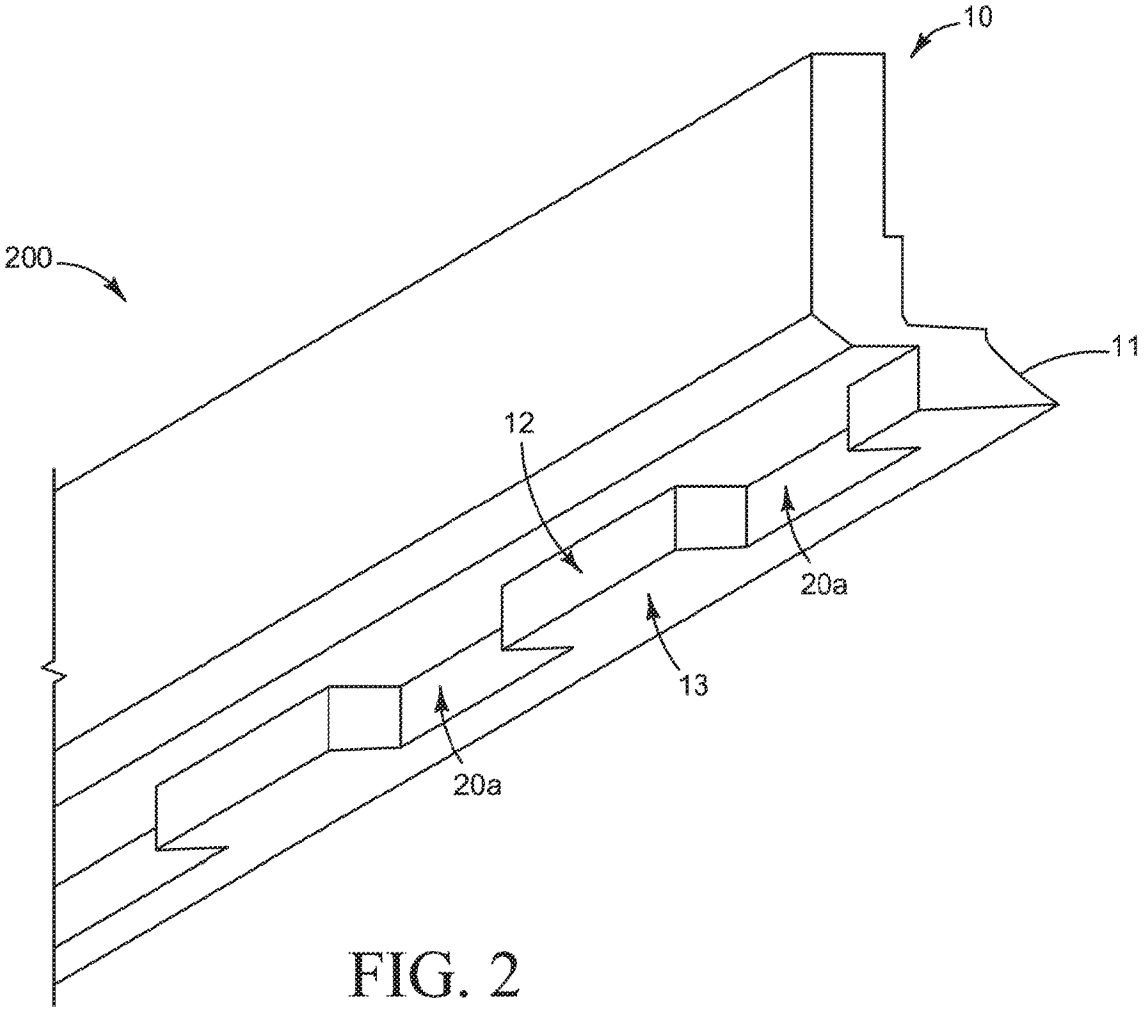
FIG. 2 is a perspective view illustrating a media crash prevention device according to an example.
Figure 3A:
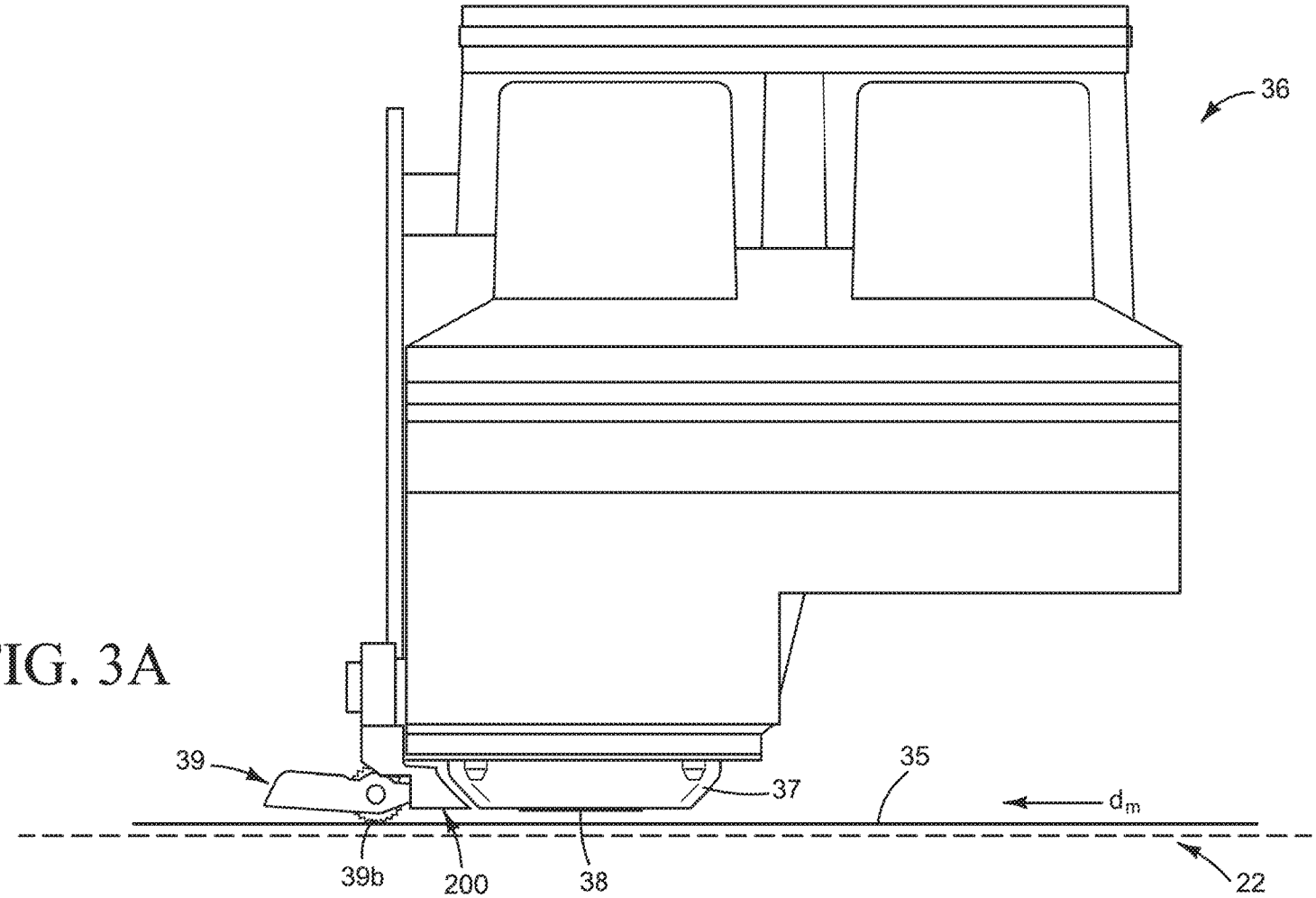
FIGS. 3A and 3B are side views illustrating a media control member and the media crash prevention device of FIG. 2 coupled to a printhead according to examples.
Figure 3B:
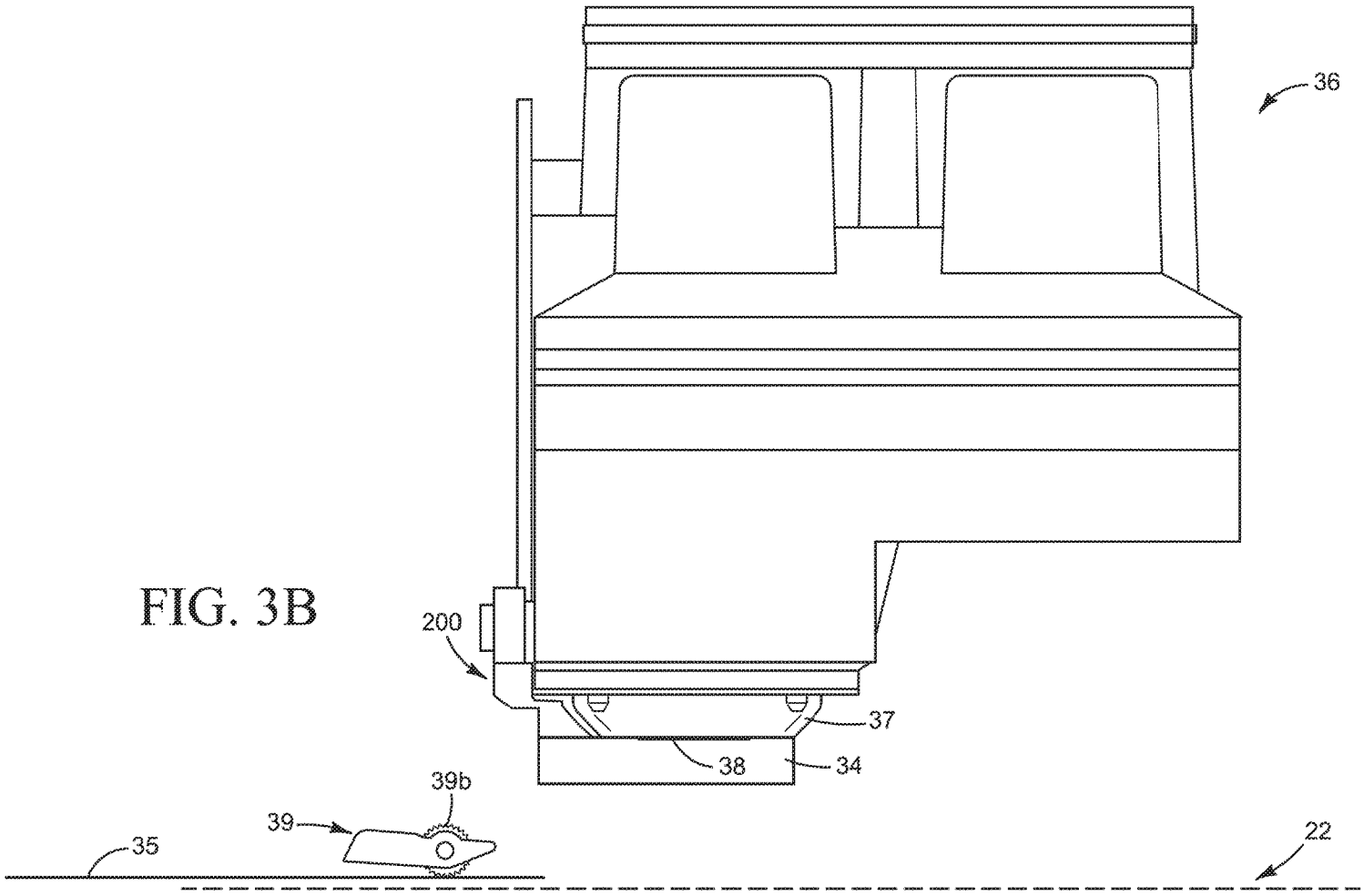
Figure 4:
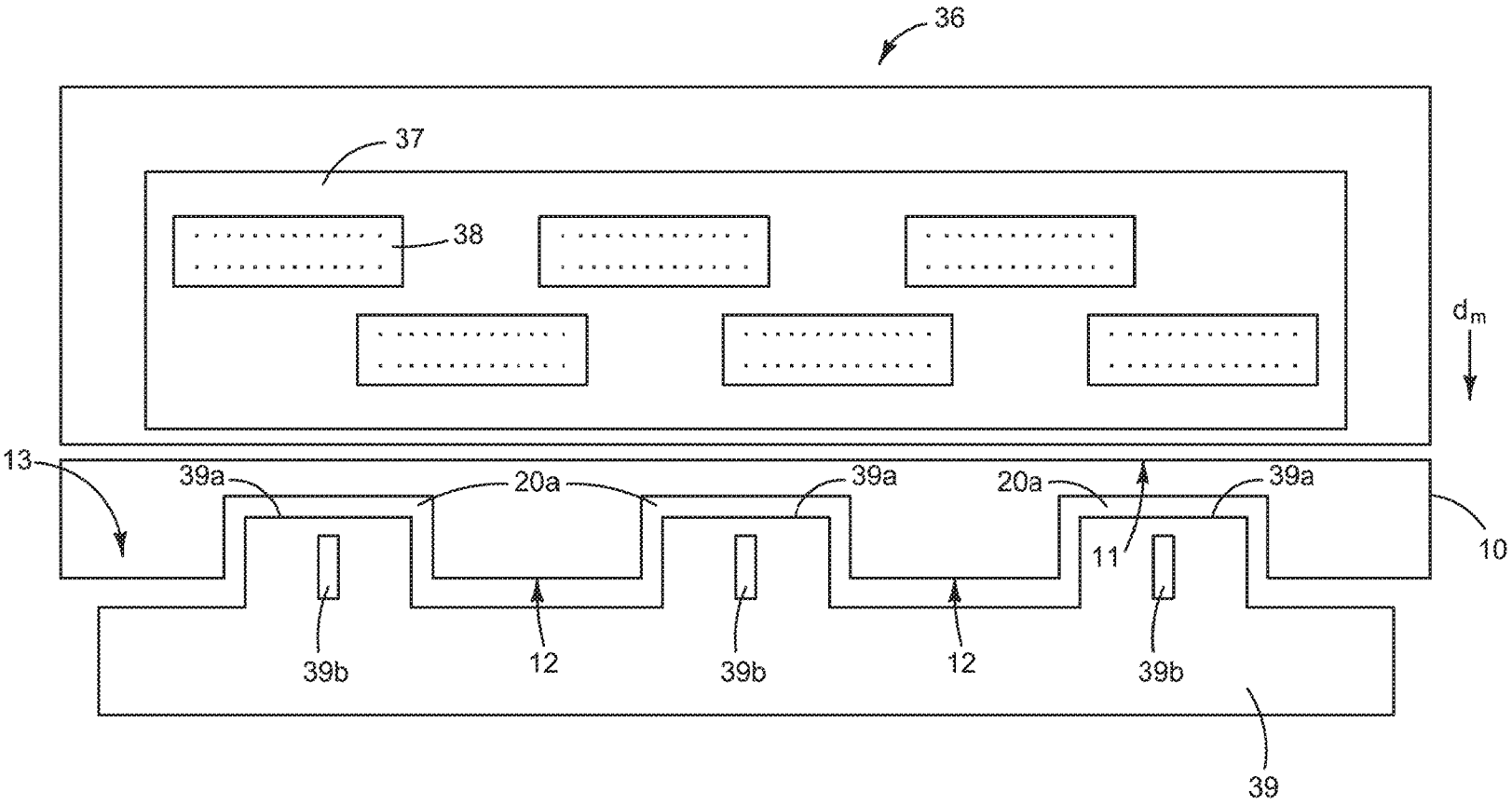
FIG. 4 is a bottom view illustrating the media control member and the media crash prevention device coupled to the printhead of FIG. 3A according to an example.

FIG. 2 is a perspective view illustrating a media crash prevention device according to an example. FIGS. 3A and 3B are side views illustrating a media control member and the media crash prevention device of FIG. 2 coupled to a printhead in the printing position and the maintenance position, respectively, according to examples. FIG. 4 is a bottom view illustrating the media control member and the media crash prevention device coupled to the printhead of FIG. 3A according to an example. In some examples, the media crash prevention device 200 includes the interleave member 10 as previously discussed with respect to the media crash prevention device 100 of FIG. 1. Referring to FIGS. 2-4, in some examples, the interleave member is coupled to a printhead 36 having a shroud 37 surrounding at least one nozzle surface 38 and positioned downstream from the shroud 37 in a media transport direction $d_m$.

Referring to FIGS. 2-4, in some examples, the interleave member 10 includes a shroud conforming surface 11, a media control conforming surface 12, and a media crash prevention surface 13. A shape of the shroud conforming surface 11 may conform to a shape of a surface of the shroud 37 positioned across therefrom. Such conformity may enable the shroud conforming surface 11 and the shroud 37 to reduce and/or eliminate a spacing there between to be closely positioned to each other. For example, a distance between the shroud conforming surface 11 and the shroud opposite thereof may be less than 0.5 mm. In some examples, the shape of the shroud conforming surface 11 may be curved. For example, the shape of the shroud conforming surface 11 may be concave and the shape of a corresponding portion of the shroud 37 may be convex.

Referring to FIGS. 2-4, in some examples, a shape of the media control conforming surface 12 may conform to a shape of a surface of the media control member 39 positioned across therefrom. Such conformity may enable the media control conforming surface 12 and the media control member 39 to reduce and/or eliminate a spacing there between to be closely positioned to each other. That is, the media control conforming surface 12 conforms to a surface of the media control member 39 to position the interleave member 10 close to and opposite the media control member 39 in the printing position (FIG. 3A). For example, a distance between the media conforming surface 12 and the media control member 39 opposite thereof may be less than 2.0 mm. Additionally, the conformity may enable the media control conforming surface 12 to be moved away from the media control member 39 in the maintenance position (FIG. 3B). In the maintenance position, for example, a cleaning device 34 may clean the printhead 36 and the media crash prevention surface 13. The shape of the media control conforming surface 12 may include a plurality of indents 20*a* to receive and correspond with a plurality of protrusions 39*a* of the surface of the media control member 39. The media control member 39 may include a plurality of star wheels 39*b* to guide the media 35 along a media, path 22.

Referring to FIGS. 2-4, in some examples, the media crash prevention surface 13 includes a planar region that is substantially parallel to the nozzle surface 38. For example, the media crash prevention surface 13 may be arranged in alignment with and in a substantially same plane as the nozzle surface 38. Thus, a transition from the shroud 37 to the interleave member 10 may be smooth and non-binding to a media edge that may periodically come in contact therewith. Additionally, advancement of the media 35 may continue in a guided manner to the media control member 39 downstream from the printhead 36 along a media path 22 in a media transport direction $d_m$. Thus, positional control of the media 35 over the shroud 38 and to the media control member 39 may be obtained. Also, media crashes in the print zone due to media curl may be reduced.

Figure 5:
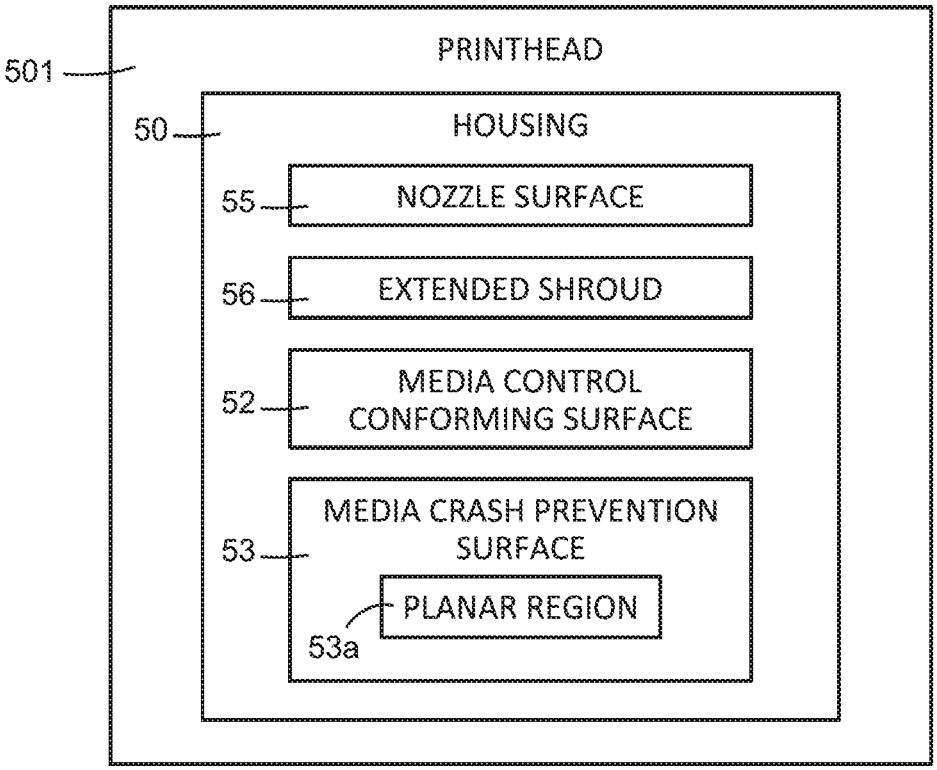
FIG. 5 is a block diagram illustrating a printhead according to an example.

FIG. 5 is a block diagram illustrating a printhead according to an example. The printhead 501 is usable with a cowcatcher. A cowcatcher is a media control member of a printing system that receives and guides media along a media path 22. The printing system may include page-wide array printers, and the like. The printhead 501 is movable between a printing position and a maintenance position. Referring to FIG. 5, in some examples, the printhead 501 includes a housing 50. The housing 50 includes a nozzle surface 55 and an extended shroud 56 surrounding the nozzle surface 55. The extended shroud 56 includes a media control conforming surface 52 and a media crash prevention surface 53. The media control conforming surface 52 conforms to a surface of the cowcatcher to position the extended shroud 56 close to and opposite the cowcatcher in the printing position.

Thus, advancement of the media may continue in a guided manner from the print zone to the cowcatcher downstream from the printhead 501 in a media transport direction. Thus, positional control of the media over the extended shroud 56 and to the cowcatcher may be obtained. Also, media crashes in the print zone due to media curl may be reduced, even with respect to duplex printing and media feed in a short grain (e.g., in a widthwise direction of the media). That is, in duplex printing, a media curl may be formed after a first side of the media is printed on. Consequently, when the media is transported back into the print zone for the printhead to print on the second side thereof, the media curl may contact and be guided by the media crash prevention surface 53. The media control conforming surface 52 conforms to the surface of the cowcatcher to position the extended shroud 56 away from the cowcatcher in the maintenance position. The media crash prevention surface 53 includes a planar region to periodically contact and guide the media to the cowcatcher. The media crash prevention surface 53 is disposed proximate to and across from the cowcatcher in the printing position. The media crash prevention surface 53 is disposed away from the cowcatcher in the maintenance position.

Figure 6A:
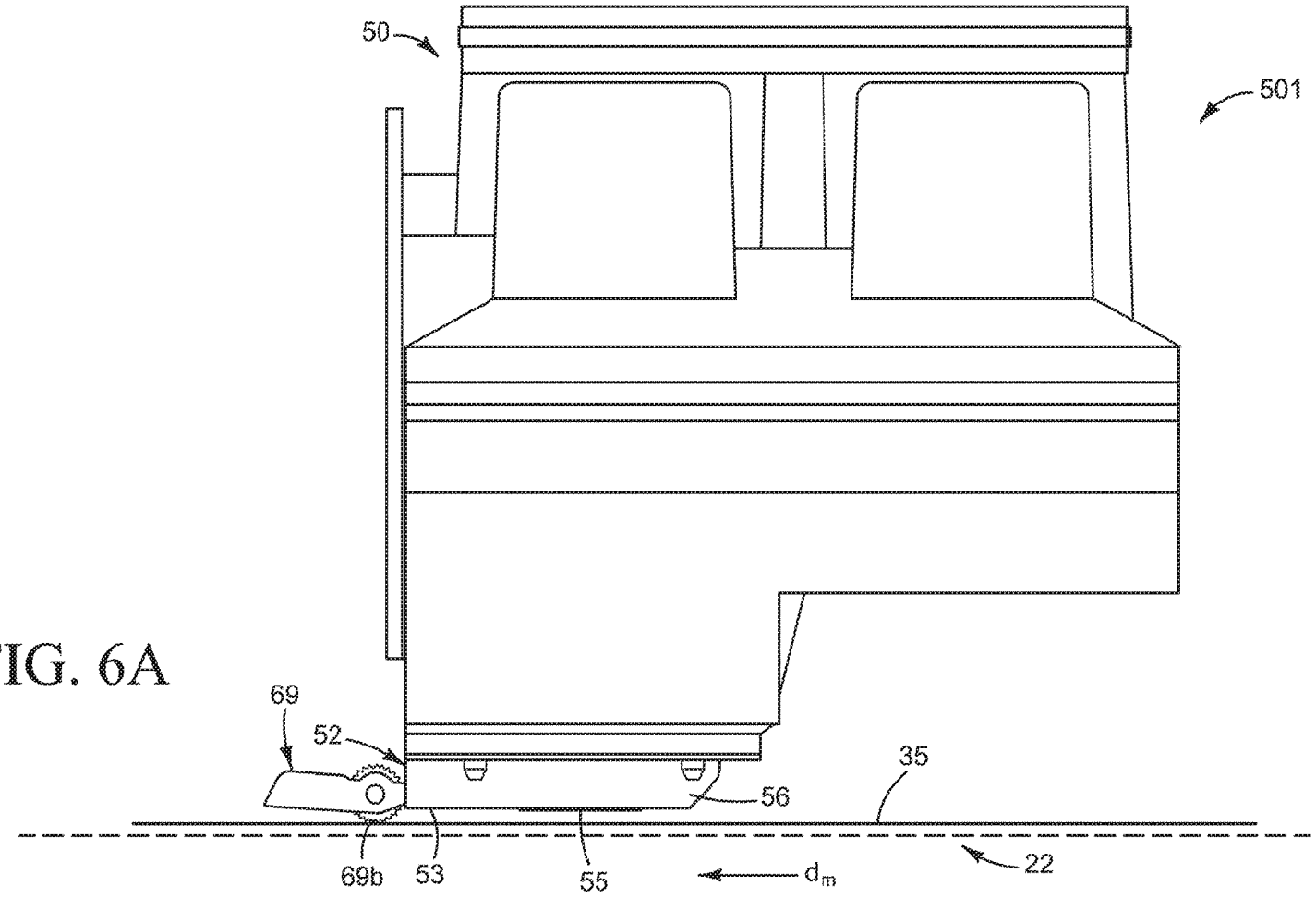
FIGS. 6A and 6B are side views illustrating a cowcatcher and the printhead of FIG. 5 in a printing position and a maintenance position, respectively, according to examples.
Figure 6B:
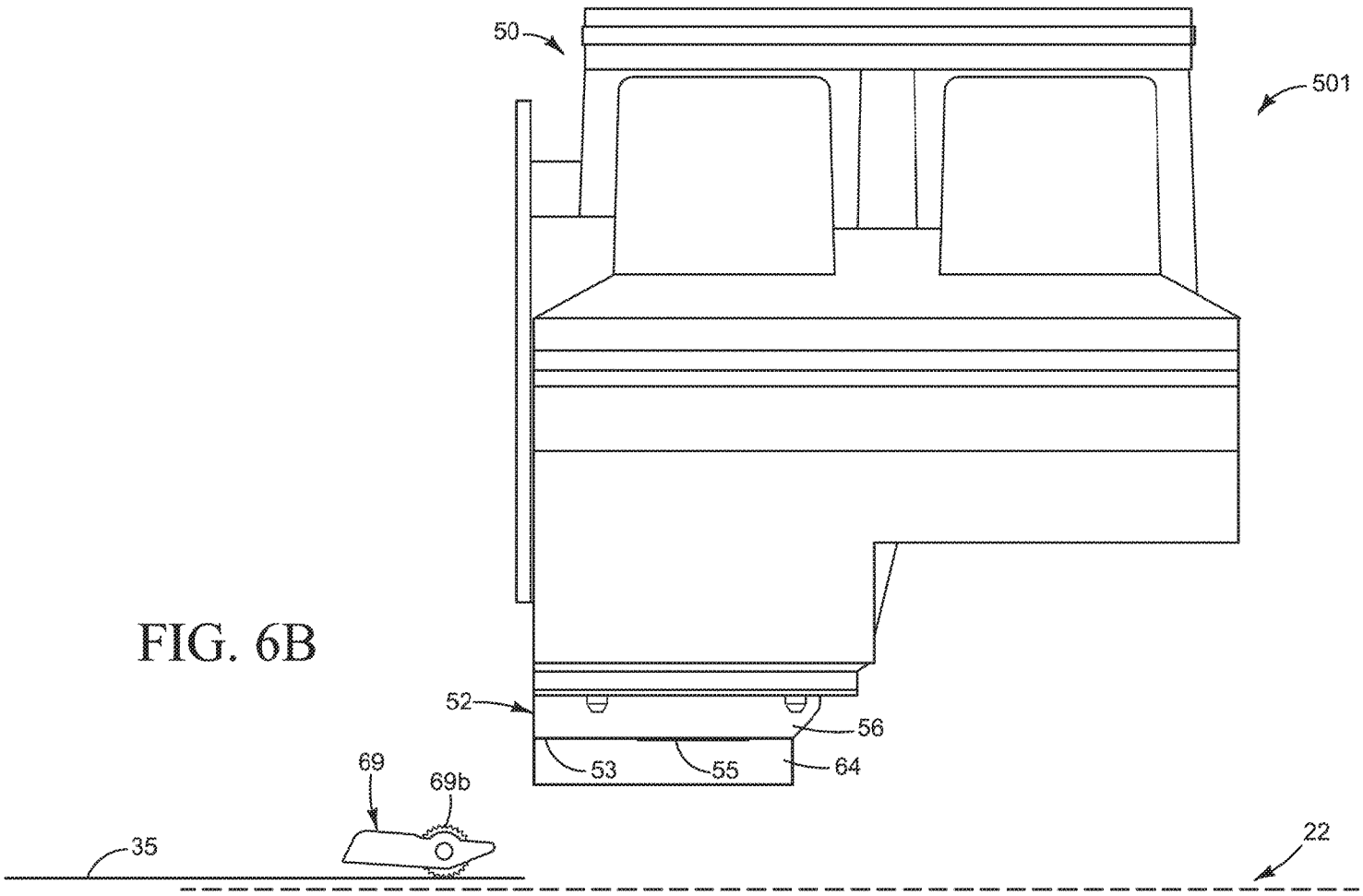
Figure 7:
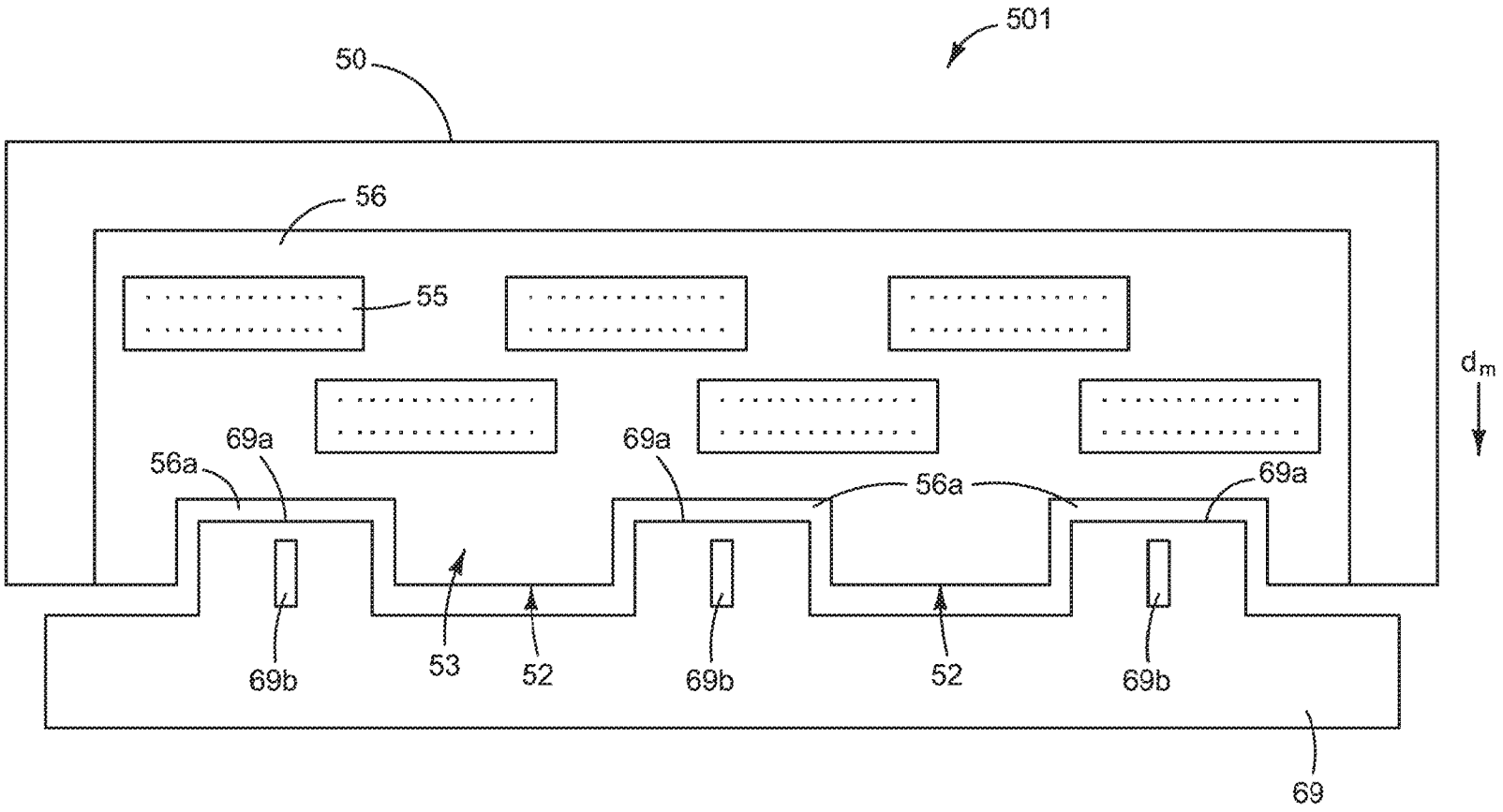
FIG. 7 is a bottom view illustrating the cowcatcher and the printhead of FIG. 6A according to an example.

FIGS. 6A and 6B are side views illustrating a cowcatcher and the printhead of FIG. 5 in a printing position and a maintenance position, respectively, according to examples. FIG. 7 is a bottom view illustrating the cowcatcher and the printhead of FIG. 6A according to an example. The printhead 501 includes a housing 50 as previously discussed with respect to FIG. 5. The housing 50 includes a nozzle surface 55 and an extended shroud 56 surrounding the nozzle surface 55. The extended shroud 56 includes a media control conforming surface 52 and a media crash prevention surface 53. Referring to FIGS. 6A-7, in some examples, a shape of the media control conforming surface 52 may conform to a shape of a surface of the cowcatcher 69 positioned across therefrom.

Such conformity may enable the media control conforming surface 52 and the cowcatcher 69 to reduce and/or eliminate a spacing there between to be closely positioned to each other in the printing position (FIG. 6A). For example, a distance between the media control conforming surface 52 and the cowcatcher 69 may be less than 0.5 mm. Additionally, the conformity may enable the media control conforming surface 52 to be moved away from the cowcatcher 69 in the maintenance position (FIG. 6B). In the maintenance position, for example, a cleaning device 64 may clean the printhead 501. The shape of the media control conforming surface 52 may include a plurality of indents 56*a* to receive and correspond with a plurality of protrusions 69*a* of the surface of the cowcatcher 69. The cowcatcher 69 may include a plurality of star wheels 69*b* to guide the media 35.

Referring to FIGS. 6A-7, in some examples, the media crash prevention surface 53 includes a planar region 53*a* (FIG. 5) that is substantially parallel to the nozzle surface 55. For example, the media crash prevention surface 53 may be arranged in alignment with and in a substantially same plane as the nozzle surface 55. Thus, a transition from the extended shroud 56 to the cowcatcher 69 may be smooth and non-binding to a media edge that may periodically come in contact therewith. Additionally, advancement of the media 35 may continue in a guided manner from the extended shroud 56 to the cowcatcher 69 downstream from the printhead 501 in a media transport direction $d_m$. Thus, media crashes in the print zone due to media curl may be reduced.

Figure 8:
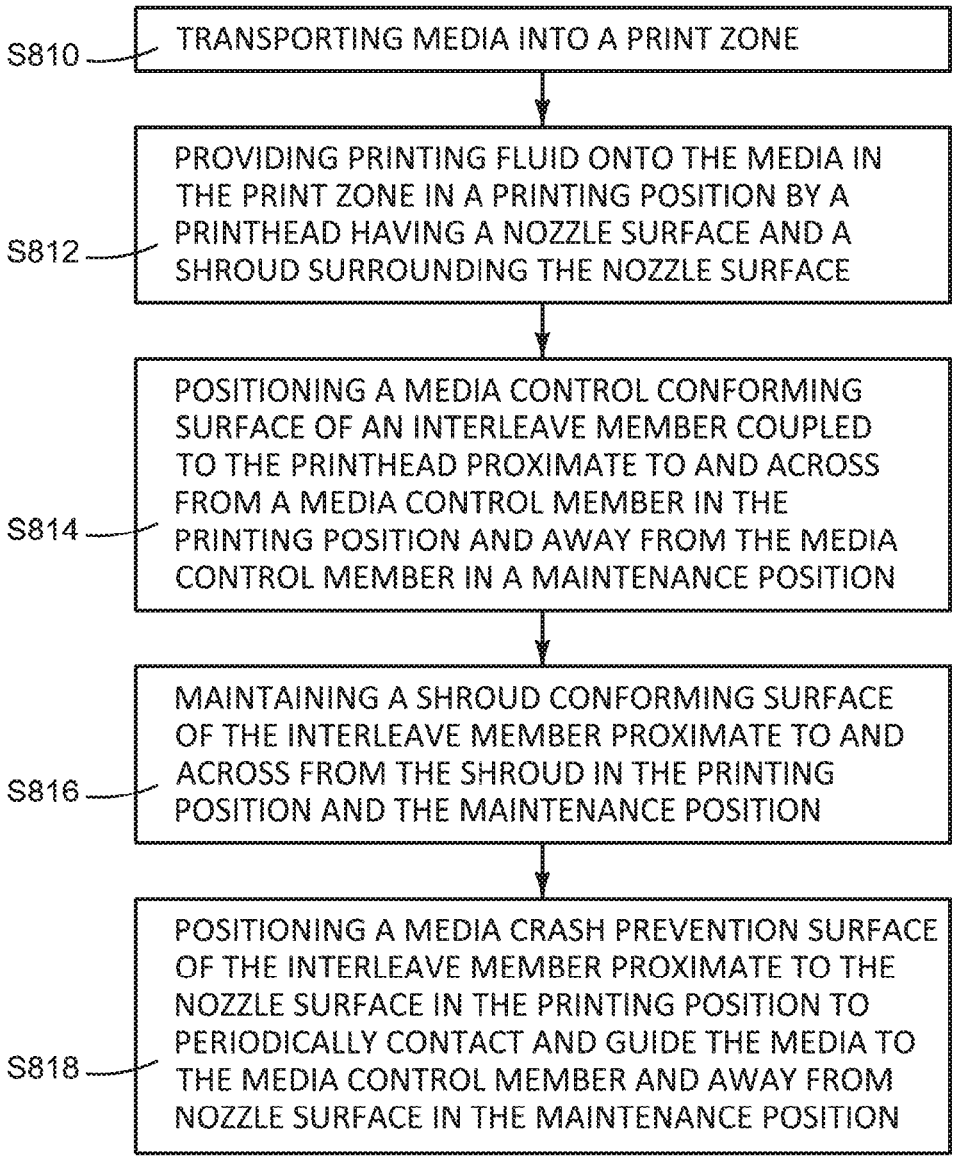
FIG. 8 is a method of reducing media crashes according to an example.

FIG. 8 is a method of reducing media crashes according to an example. In some examples, the modules, assemblies, and the like, previously discussed with respect to FIGS. 1-7 may be used to implement the method of FIG. 8. In block S810, media is transported into a print zone. In some examples, transporting the media into a print zone may include transporting the media into the print zone to provide printing fluid on a second side of the media after a first side of the media previously received printing fluid such as in duplex printing. In block S812, printing fluid is provided onto the media in the print zone in a printing position by a printhead having a nozzle surface and a shroud surrounding the nozzle surface. For example, an inkjet printhead may eject ink onto the media placed in the print zone to form an image thereon.

In block S814, a media control conforming surface of an interleave member coupled to the printhead is positioned proximate to and across from a media control member in the printing position and away from the media control member in a maintenance position. For example, when the printhead coupled with the interleave member is moved toward the media path, the media control conforming surface is placed close to and in alignment with the media control member. For example, when the printhead with the interleave member is moved away from the media path, the media control conforming surface is moved away from the media control member. In some examples, the shape of the media control conforming surface includes a plurality of indents to receive and correspond with a plurality of protrusions of the surface of the media control member.

In block S816, a shroud conforming surface of the interleave member is maintained proximate to and across from the shroud in the printing position and the maintenance position. For example, the interleave member is attached to the printhead in a manner in which a small and constant amount of space exist between the shroud conforming surface and the shroud.

In block S818, a media crash prevention surface of the interleave member is positioned proximate to the nozzle surface in the printing position to periodically contact and guide the media to the media control member and away from nozzle surface in the maintenance position. For example, when the printhead coupled with the interleave member is moved toward the media path, the media crash prevention surface is placed close to and in alignment with the nozzle surface. Alternatively, for example, when the printhead with the interleave member is moved away from the media path, the media crash prevention surface is moved away from the nozzle surface. In some examples, positioning a media crash prevention surface of the interleave member proximate to the nozzle surface in the printing position to periodically contact and guide the media to the media control member and away from the nozzle surface in the maintenance position may include positioning the media crash prevention surface substantially parallel to the nozzle surface. For example, the media crash prevention surface may be positioned in alignment with and in a substantially same plane as the nozzle surface.

It is to be understood that the flowchart of FIGS. 8 illustrates architecture, functionality, and/or operation of examples of the present disclosure. Although the flowchart of FIG. 8 illustrates a specific order of execution, the order of execution may differ from that which is depicted. For example, the order of execution of two or more blocks may be rearranged relative to the order illustrated. Also, two or more blocks illustrated in succession in FIG. 8 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A media crash prevention device usable with a printhead, the media crash prevention device comprising:

an interleave member to couple to the printhead having a shroud surrounding a nozzle surface thereof and movable between a printing position and a maintenance position, the interleave member including a shroud conforming surface, a media control conforming surface, and a media crash prevention surface;

the shroud conforming surface to be positioned proximate to and across from the shroud;

the media control conforming surface to be positioned proximate to and across from a media control member in the printing position and away from the media control member in the maintenance position; and the media crash prevention surface to periodically contact and guide a media to the media control member in the printing position.

2. The media crash prevention device of claim 1, wherein the interleave member is positioned downstream from the shroud in a media transport direction.

3. The media crash prevention device of claim 1, wherein a shape of the shroud conforming surface conforms to a shape of a surface of the shroud positioned across therefrom and a shape of the media control conforming surface conforms to a shape of a surface of the media control member positioned across therefrom.

4. The media crash prevention device of claim 3, wherein the shape of the shroud conforming surface is curved.

5. The media crash prevention device of claim 3, wherein the shape of the media control conforming surface includes a plurality of indents to receive and correspond with a plurality of protrusions of the surface of the media control member.

6. The media crash prevention device of claim 1, wherein the media crash prevention surface is substantially planar and substantially parallel to the nozzle surface.

7. The media crash prevention device of claim 1, wherein the media crash prevention surface is arranged in alignment with and in a substantially same plane as the nozzle surface.

8. A printhead movable between a printing position and a maintenance position and usable with a cowcatcher, the printhead comprising:

a housing including a nozzle surface and an extended shroud surrounding the nozzle surface;

the extended shroud including a media control conforming surface and a media crash prevention surface;

the media control conforming surface conforming to a surface of the cowcatcher to position the extended shroud close to and opposite the cowcatcher in the printing position and away from the cowcatcher in the maintenance position; and the media crash prevention surface including a planar region to periodically contact and guide the media to the cowcatcher, the media crash prevention surface disposed proximate to and across from the cowcatcher in the printing position and away from the cowcatcher in the maintenance position.

9. The printhead of claim 8, wherein the shape of the media control conforming surface includes a plurality of indents to receive and correspond with a plurality of protrusions of the surface of the cowcatcher.

10. The printhead of claim 8, wherein the planar region is substantially parallel to the nozzle surface in the printing position.

11. A method of reducing media crashes, the method comprising:

transporting media into a print zone;

providing printing fluid onto the media in the print zone in a printing position by a printhead having a nozzle surface and a shroud surrounding the nozzle surface;

positioning a media control conforming surface of an interleave member coupled to the printhead proximate to and across from a media control member in the printing position and away from the media control member in a maintenance position;

maintaining a shroud conforming surface of the interleave member proximate to and across from the shroud in the printing position and the maintenance position; and positioning a media crash prevention surface of the interleave member proximate to the nozzle surface in the printing position to periodically contact and guide the media to the media control member and away from nozzle surface in the maintenance position.

12. The method of claim 11, wherein the positioning a media crash prevention surface of the interleave member proximate to the nozzle surface in the printing position to periodically contact and guide the media to the media control member and away from the nozzle surface in the maintenance position further comprises:

positioning the media crash prevention surface substantially parallel to the nozzle surface.

13. The method of claim 11, wherein the positioning a media crash prevention surface of the interleave member proximate to the nozzle surface in the printing position to periodically contact and guide the media to the media control member and away from nozzle surface in the maintenance position further comprises:

positioning the media crash prevention surface in alignment with and in a substantially same plane as the nozzle surface.

14. The method of claim 13, wherein transporting media into a print zone further comprises:

transporting the media into the print zone to provide printing fluid on a second side of the media after a first side of the media previously received printing fluid.

15. The method of claim 14, wherein the shape of the media control conforming surface includes a plurality of indents to receive and correspond with a plurality of protrusions of the surface of the media control member.

* * * * *